US010660422B2

(12) United States Patent
Dourlens et al.

(10) Patent No.: US 10,660,422 B2
(45) Date of Patent: May 26, 2020

(54) PROCESS AND DEVICE FOR FILLING A UNIT CONTAINER FROM A CAPSULE, AND CAPSULE USABLE FOR THAT PURPOSE

(71) Applicant: Parfums Christian Dior, Paris (FR)

(72) Inventors: Arnaud Dourlens, Combleux (FR); Emeric Baracat, Croissy sur Seine (FR); Jean-Dominique Bosq, Orleans (FR)

(73) Assignee: Parfums Christian Dior, Paris (FR)

( * ) Notice: Subject to any disclaimer, the term of this patent is extended or adjusted under 35 U.S.C. 154(b) by 19 days.

(21) Appl. No.: 14/899,736

(22) PCT Filed: Jun. 18, 2014

(86) PCT No.: PCT/FR2014/051510
§ 371 (c)(1),
(2) Date: Dec. 18, 2015

(87) PCT Pub. No.: WO2014/202902
PCT Pub. Date: Dec. 24, 2014

(65) Prior Publication Data

US 2016/0143416 A1 May 26, 2016

(30) Foreign Application Priority Data

Jun. 18, 2013 (FR) ..... 13 55690

(51) Int. Cl.
*A45D 40/16* (2006.01)
*B65B 63/08* (2006.01)
(Continued)

(52) U.S. Cl.
CPC ..... *A45D 40/16* (2013.01); *A45D 34/00* (2013.01); *A45D 40/26* (2013.01); *B65B 63/08* (2013.01); *A45D 40/00* (2013.01); *B65B 29/00* (2013.01)

(58) Field of Classification Search
CPC ..... A45D 34/00; A45D 40/00; A45D 40/16; A45D 40/26; A45D 40/04; B65B 29/00; B65B 63/08
(Continued)

(56) References Cited

U.S. PATENT DOCUMENTS 2,767,834 A 10/1956 Reine
3,443,874 A * 5/1969 Morane ..... A45D 40/02 206/385
(Continued)

FOREIGN PATENT DOCUMENTS

DE 202004009453 U1 8/2004
FR 2194113 A5 2/1974
(Continued)

OTHER PUBLICATIONS

International Search Report for related international Application No. PCT/FR2014/051510; report dated Jul. 23, 7014.

*Primary Examiner* — Timothy L Maust
(74) *Attorney, Agent, or Firm* — Miller, Matthias & Hull LLP

(57) ABSTRACT

The invention proposes a process for filling a unit container with a cosmetic product from a capsule containing a dose of said cosmetic product, where said capsule comprises a tube filled with said dose of cosmetic product, where said tube extends between a first end closed by a piston slidably mounted in a cylinder and a second end forming an initially closed outlet nozzle, and where said process comprises at least a preparatory step during which the outlet nozzle of the capsule is opened and at least one step of casting in which said cosmetic product is cast into the cosmetic product container.

18 Claims, 14 Drawing Sheets

(51) Int. Cl.

| | |
|---|---|
| ***A45D 34/00*** | (2006.01) |
| ***A45D 40/26*** | (2006.01) |
| *A45D 40/00* | (2006.01) |
| *B65B 29/00* | (2006.01) |

(58) Field of Classification Search
USPC ..... 141/12
See application file for complete search history.

(56) References Cited

U.S. PATENT DOCUMENTS 4,621,935 A * 11/1986 Sussman ..... A45D 40/02 220/200
4,706,693 A 11/1987 Spector
5,316,712 A * 5/1994 Ono ..... A45D 40/16 264/102
5,346,323 A * 9/1994 Harris ..... A45D 40/02 401/82
5,533,823 A * 7/1996 Pierpont ..... A45C 13/008 215/342
5,860,569 A * 1/1999 Gregoire ..... A61J 1/2093 222/129
6,000,872 A * 12/1999 Velicka ..... A45D 40/06 401/88
6,086,276 A * 7/2000 Gueret ..... A45D 40/04 401/54
6,116,802 A * 9/2000 Gueret ..... A45C 13/008 401/78
6,338,840 B1 * 1/2002 Allan ..... A45D 40/16 264/102
7,488,129 B1 * 2/2009 Prischak ..... A45D 40/04 401/68
8,187,578 B2 * 5/2012 Walling ..... A45D 40/06 220/665
8,875,955 B2 * 11/2014 Arora ..... A45D 40/04 222/386
2004/0134562 A1 7/2004 Engel
2009/0184173 A1 * 7/2009 Duru ..... A45D 34/00 239/1

FOREIGN PATENT DOCUMENTS

JP S63138976 A 6/1988
JP H03149004 A 6/1991
JP 2009233652 A 10/2009

* cited by examiner

PROCESS AND DEVICE FOR FILLING A UNIT CONTAINER FROM A CAPSULE, AND CAPSULE USABLE FOR THAT PURPOSE

CROSS-REFERENCE TO RELATED APPLICATION

This Application is a 35 USC § 371 US National Stage filing of International Application No. PCT/FR2014/051510 filed on Jun. 18, 2014, and claims priority under the Paris Convention to French Patent Application No. 13 55690 filed on Jun. 18, 2013.

FIELD OF THE DISCLOSURE

The present invention relates to processes and devices for filling a unit container such as a vial or applicator tube with cosmetic product, in particular solid, from a removable capsule and the capsules usable for this purpose.

BACKGROUND OF THE DISCLOSURE

Lip makeup or lip care products are most often packaged in vials or tubes such as those commonly called "lipstick tubes".

Cosmetic products are usually made industrially in relatively large production runs on packaging machines which operate at high speeds.

Considering the number of units to be packaged in a short time interval, the step of filling cosmetic products into their final container (vials or tubes) is optimized so as to be able to produce the largest possible number of units in a short time.

Additionally, the nature of these products leads to implementing a succession of heating and cooling steps during filling which requires the use of equipment suited to an industrial production scale.

Because of the number of units to be produced and technical constraints associated with the preparation and packaging of cosmetic products, only a limited choice of shades or textures preselected by the producer can be offered to the client for a single cosmetic product.

Additionally, cosmetic products have a limited lifetime after the industrial production thereof. Consequently, the points of sale of beauty products only maintain a relatively limited stock of these products which further limits the choice of shades or textures offered to consumers.

Finally for a single line of products, the container (e.g. tube, vial) is identical whatever the shade and/or texture, which prevents clients from being able to fully customize their cosmetic product by adapting the selected shade and/or texture to the container of their choice.

This is particularly true for lipstick, for which the client cannot adapt the shade and/or texture on the mechanism of their choice, or else for mascara for which the brush is sold with the packaged product.

If a producer wants to expand the selections for the clients thereof, the producer has no other choice than to multiply the mass production of products, which is economically risky and costly.

In the following description of the invention, the generic term "lipstick" or "lipstick composition" or "lipstick tube" is understood to mean a solid product suited for makeup and or lip care, without limitation of shade or texture, which can be stably, over time and at environmental temperature, shaped into a rod or stick shape.

"Solid product" is understood to mean a product which could be penetrated by a semirigid object without consequently losing the integrity thereof when it is shaped into a given shape such as a rod.

SUMMARY OF THE DISCLOSURE

The goal of the present invention is in particular to remedy all or part of the aforementioned disadvantages.

The invention proposes a process for filling a unit container with a cosmetic product from a capsule containing a dose of said cosmetic product, where said capsule comprises a tube filled with said dose of cosmetic product, where said tube extends between a first end closed by a piston slidably mounted in the tube and a second end forming an initially closed outlet nozzle, and where said process comprises at least the following steps:

- a step of opening the outlet nozzle of the capsule;
- a step of casting in which said cosmetic product is cast into a container by actuating the piston of the capsule in order to expel said cosmetic product by the outlet nozzle;
- and, a step according to which the cosmetic product can be fluidified in the capsule by heating.

Because of these provisions, the process according to the invention serves to unitarily package cosmetic products, for example lipstick tubes, personalized and on-demand, in which the client can be left to choose the shade and/or texture of the cosmetic product (for example a lipstick, gloss or mascara composition) and also the container itself. With the process, the consumer can fully customize their own finished product constituted of a cosmetic product (e.g. lipstick, foundation, mascara, etc.) packaged in a container.

With the process from the invention, the packaged finished products can be produced at the point-of-sale, in front of the immediate consumer after the consumer has made their choice of both the cosmetic product and also the container.

According to a specific implementation, which will be described later in connection with an embodiment, the invention can for example relate to a process for filling a solid cosmetic product, such as a lipstick, applicator tube from a capsule containing one dose of said product; process in which, in a first step said cosmetic product can be fluidified in the capsule by heating before opening the outlet nozzle of the capsule.

Because of these dispositions, with the process according to the invention, personalized and on-demand applicator tubes of solid cosmetic product, for example lipstick tubes, can be created one unit at a time.

Additionally, because the cosmetic products are contained in hermetically sealed unit capsules, there is the additional advantage of being able to store cosmetic products longer.

In various embodiments of the process according to the invention, it could also include the following steps taken separately or in combination:

- the heating of the cosmetic product in the capsule can be done at a temperature included substantially between 80 and 100° C., where preferably the temperature can be 90° C.;
- the heating can also be done optionally in the case where a pasty or semisolid product is to be slightly fluidified so as to make the expulsion of the cosmetic product from the capsule easier;
- The heating can be done for a time substantially included between one and five minutes, preferably for about four minutes;

The step of opening said outlet nozzle of said capsule can be done by cutting-off a separable head that said capsule comprises;

The process can additionally comprise, after said casting step, a cooling step in which the cosmetic product is solidified in the unit container;

The cooling step can be done by blowing air; and

The cooling step can be done for a time included substantially between one minute and five minutes, and preferably a time of about four minutes.

The cooling step is particularly useful in the case where the process for filling an applicator tube with solid cosmetic product, previously fluidified by heating during the preparatory step is implemented. The cooling accelerates the return of the cosmetic product to the initial solid-state, shaping thereof and making the product available to the client.

Additionally, an objective of the invention is also a capsule comprising a tube extending between a first end closed by a piston slidably mounted within the tube and a second end forming an outlet nozzle which is closed, where said tube is filled with a cosmetic product and where the product is in solid form.

As previously explained, such a capsule has the advantage of allowing a better storage of the product (for example, for the lipstick tip) than that of a conventional applicator device after packaging.

The presence of a piston closing one of the ends of the capsule serves, throughout the process from the invention, to avoid contact between the cosmetic product contained in the capsule and any nonremovable part of the filling device conforming to the invention that will be defined later. Such is not the case for the usual filling devices which fill containers in mass production.

In various embodiments of the capsule according to the invention, one and/or another of the following dispositions could be used advantageously:

The outlet nozzle of the capsule can be hermetically closed by a separable head;

A rigid cap can be placed against the piston of the capsule;

The tube of the capsule is made of a solid material with a melting point over 100° C.;

The tube can be made of a transparent material;

The piston of the capsule can also be made of a transparent material.

The use of such a transparent material for the tube also makes the shade of the cosmetic product that it contains visible before implementing the process from the invention.

The filling of the removable capsule can be done by hot casting of said cosmetic product by the non-separable end of said capsule and then closure by insertion of the piston.

After use for production of a cosmetic product packaged in a unit container, the capsule can be retrieved by an operator and recycled.

The capsule can be made of any type of rigid material compatible with the cosmetic product that it contains and compatible with the conditions for implementation of the process (e.g. heating, cooling, separating).

The material can advantageously be a white, colored or tinted glass or even include a decorative exterior dressing or an indicative impression (e.g. mark, reference, etc.), a thermoplastic polymer (e.g. polyethylene, polyethylene terephthalate or polyoxymethylene) or any other material which does not deform under the effect of a heat increase.

The tube of the capsule advantageously has a cylindrical shape.

The shape of the piston is suited so as to slide without hindrance along the walls of said tube and to expel the entirety of the cosmetic product, apart from dead volume, from the capsule.

Finally, an objective of the invention is a device for filling a unit container with a cosmetic product from a capsule such as defined above, where said capsule is removable from said device and where said device comprises;

means for opening, suited for opening the outlet nozzle of said capsule;

and means for casting said cosmetic product, suited for casting said cosmetic product—fluidified in the applicator tube—by actuating the piston of the capsule in order to expel said cosmetic product by said outlet nozzle.

According to a particularly preferred implementation an object of the invention is a filling device for a cosmetic product unit container which is simple to use, easily usable by an operator having been trained in advance, which does not need any particular maintenance and in particular no cleaning between two uses because of the use of removable capsules and which is low bulk. These advantages make it possible to install said device at a point-of-sale for producing cosmetic products personalized according to the selections by the consumers, for example a tube of lipstick whose shade, texture and also even the applicator tube can be selected by the consumer herself.

More specifically the present invention aims at a filling device for a cosmetic product unit container, in particular solid, like for example a lipstick tube, through the use of a removable capsule containing a dose of said cosmetic product.

The device according to the invention can also comprise:

means for preparation of the capsule, suited for fluidifying said cosmetic product contained in the capsule by heating and for opening the outlet nozzle of said capsule; and means for casting said cosmetic product suited for casting said fluidified cosmetic product in the unit container by actuating the piston of the capsule in order to expel said cosmetic product by said outlet nozzle.

The device according to the invention can also comprise the following features taken separately or in combination:

said means of preparation of the capsule can comprise;

a first reception housing suited for receiving said capsule;

a heating element suited for heating said capsule through said first housing;

and an opening element suited for opening said outlet nozzle of said capsule;

The heating element can comprise a heating resistance distributed around said first housing and also a halogen device;

The means for opening the outlet nozzle of the capsule can comprise at least one cutting blade which is mounted mobile between an inactive position and an active position according to which the blade cuts the outlet nozzle, and also an actuator suited to move said blade between said active position and said inactive position and vice versa;

The means for casting can comprise a rod associated with a jack, where said rod is mounted mobile in movement between a retracted inactive position and an active position according to which one end of the rod is suited to exert pressure on said piston of the capsule slidably mounted in said tube of said capsule;

The device can comprise a second reception housing suited to receive said cosmetic product unit container, initially empty, or at least a cosmetic product applicator tube mechanism;

The second housing receiving a cosmetic product unit container can be laid out in a drawer mounted mobile in movement between a retracted position serving to insert said cosmetic product unit container into said second reception housing and a filling position according to which said cosmetic product unit container is suited to be found next to the outlet nozzle of said capsule;

The device may comprise means for cooling said cosmetic product unit container through said second reception housing;

Said device can comprise means for recovering a separable head after cutting thereof, where the head is suited to close the outlet nozzle of the capsule before opening of the nozzle; and The device can comprise a display screen suited for delivering messages to an operator to inform said operator of a progression of the steps of the process such as defined above, and/or for giving the operator instructions for use of said device.

The cosmetic product can be any cosmetic composition packaged in vial or in tube.

The cosmetic product can be intended for care and/or makeup of skin, lips, eyelashes or even eyebrows.

The cosmetic product can for example be a lipstick, lip gloss, mascara, foundation, a product concealing dark circles or spots on the skin, a product for filling facial wrinkles or fine lines or even a tinted or untinted cream.

The texture of the cosmetic product, and in particular the viscosity thereof, is suited so as to be able to be packaged in a capsule such as previously described, then expelled from the capsule by action of the piston of the filling device, and finally to be able to be used comfortably by the user and produce the expected results in terms of makeup effect, length of hold after application or effectiveness of care.

In that way, the makeup product can advantageously be in semisolid or pasty form or even in solid form.

The texture is in particular adapted so as to not flow freely under gravity outside the capsule after the capsule has been opened.

In the case where the product is in solid form, a heating element and means of cooling are used so as to expel the product from the capsule in which it is packaged and into the container in which it will be cooled in order to harden and return to its initial texture.

In the case of pasty or semisolid textures, it is possible to heat the product by adapting the temperature and/or the heating time so as to make it easier to expel the cosmetic product from the capsule and to cool it so as to quickly reestablish the final texture thereof after filling the container.

The texture can be adapted by the use of gelling or thickening excipients such as for example natural or synthetic polymers with which to obtain this effect in hydrophilic or lipophilic phases, or even waxes.

The cosmetic products can additionally include preservatives, antioxidant agents, UV filters, powdery loads such as colored pigments, pearlescents or synthetic powders improving the comfort of application of the cosmetic product onto the skin or lips.

Conventionally, a solid product of the type of those that are prepared using the process from the invention is constituted of a base, advantageously anhydrous which can include a wax or mixture of waxes, oils, texturizing polymers and fatty phases. The base can be opaque, for example if wax is present or else translucent or transparent so as to emphasize the shade of the pigments which are dispersed therein.

The cosmetic product for makeup or care is deposited by contact on the surface such as the skin of the face, surface of the lips, contour of the eyes or eyelashes.

The container, also called unit packaging or packaging unit in the description, can be any type of packaging suited to the cosmetic product that it contains and/or use thereof by the consumer.

The container can be a vial, which is closed by a cap for example by screwing.

The cap can itself incorporate the application device for the product, such as a brush for application of mascara or a brush for applying the product to the lips. In this case, the application device is dipped into the cosmetic product and then withdrawn in order to be applied by the user onto the skin, lips, eyelashes or eyebrows.

The vial itself can include a leveling device with which to remove the excess product on the application device before use by the consumer. In the case of a solid cosmetic product, the container is advantageously an applicator tube such as the one which is the subject of the detailed description below.

BRIEF DESCRIPTION OF THE DRAWINGS

Other features and advantages of the invention will become apparent during the following description of an embodiment, given as a nonlimiting example, with reference to the attached drawings.

In the drawings.

DETAILED DESCRIPTION OF THE DISCLOSURE

In the various figures, the same references designate identical or similar items.

The figures which are going to be described show a device for filling a lipstick applicator tube, meaning a device with which to fill a single applicator tube at a time, upon the request of the client.

It should be understood that, even if the example described relates to a lipstick tube, the invention applies to any cosmetic product unit container, like for example vials of gloss or mascara or even tubes of foundation having a stick shape, eyeshadow tubes, or any other makeup or care product which can come in solid stick form. The invention can also apply to the preparation of unit liquid product vials, for example vials of nail polish. In this last case, the filling device and filling process will additionally be adapted to the use of volatile solvents.

The device described below is a specific implementation of the invention in that it serves to prepare a unit applicator tube containing a solid cosmetic product. The device described here in particular contains an element for heating the capsule and means for cooling the applicator tube which can be omitted in the case where the cosmetic product is not in solid form both in the capsule and in the applicator tube and does not need to be fluidified in order to be flow into the selected container.

The person skilled in the art is able to adapt the device described below to make it usable for both pasty or semisolid compositions not requiring means of heating and/or of cooling and also for filling vials with cosmetic products with solid, pasty or semisolid texture.

The device which is going to be described serves to fill a lipstick applicator tube mechanism from the capsule containing a lipstick composition (cosmetic product) with the color and texture selected by a client.

With this device serving to fill a lipstick applicator tube mechanism, it is also possible for the client to choose for themselves the applicator tube into which said mechanism will be assembled.

In that way, a fully personalized tube of lipstick can be created on demand with the invention.

Figure 1:
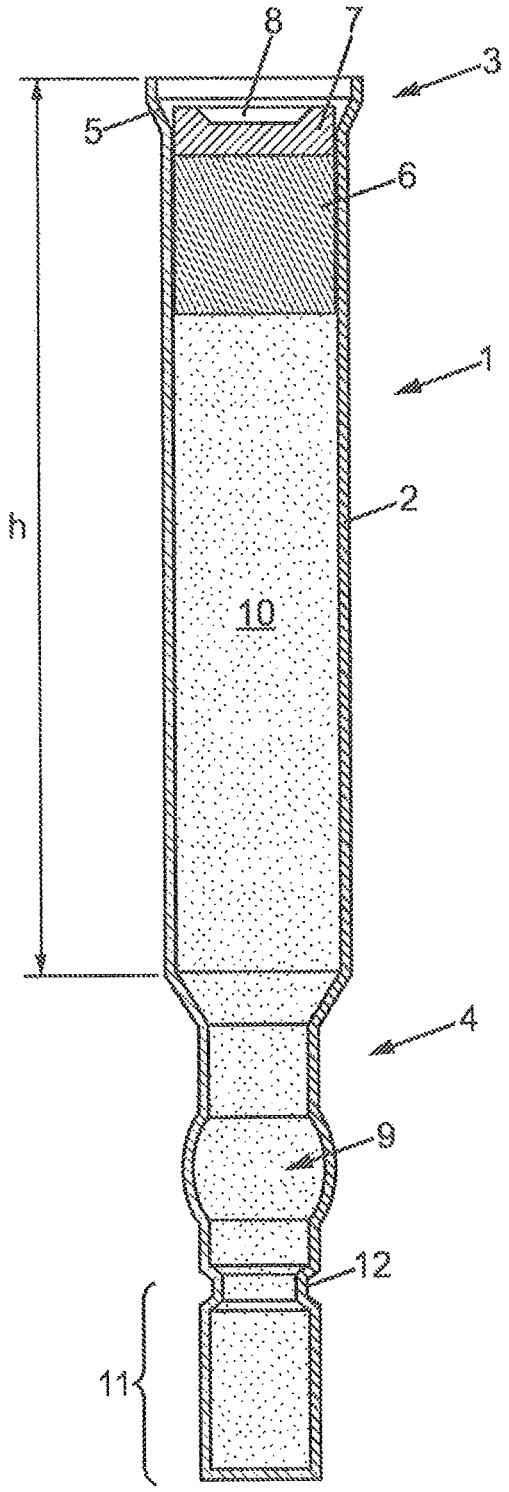
FIG. 1 shows a capsule according to the invention in section, side view.

FIG. 1 shows a capsule 1 which can be used in the filling device which will be described in a second stage.

Capsule 1 has a generally tubular shape and comprises a cylindrically shaped tube 2, indiscriminately referred to as "cylinder" in the following description, which extends from a first end 3 to a second end 4.

The cylinder 2 of the capsule 1 can be made of glass, thermoplastic polymer (polyethylene, polyethylene terephthalate or polyoxymethylene) or of any other material which does not deform under the effect of an increase of heat. In fact, and as will be seen subsequently, the filling process conforming to the invention requires heating the capsule in order to fluidify the content thereof (lipstick 10, or any other composition for care and/or makeup), in order to allow filling of the mechanism.

In particular, the cylinder 2 of the capsule is made of a solid material such as one or another cited above, for example, which resists a temperature over 100° C.

Additionally the material used is inert with respect to the lipstick composition that it contains.

The cylinder 2 is, additionally, advantageously made of a transparent material such that client can clearly observe the shade of the lipstick composition 10 contained in the capsule.

Transparent material is understood to be any untinted material allowing the shape and color of the product contained in the capsule to be clearly seen by transparency.

The first end 3 of the cylinder 2 of the capsule 1 has a shoulder 5 which will make it possible to easily withdraw the capsule 1 from a housing of the filling device (see following).

Without leaving the context of the invention, the capsule 1 could have any other means which would achieve the same function, such as an external collar for example.

Conforming to the invention, the first end 3 of the cylinder 2 of the capsule 1 is closed by a piston 6 which is slidably mounted in the cylinder 2.

The piston 6 hermetically closes the capsule 1, in the same way as a stopper. It can serve as a publicity medium and be covered, for aesthetic reasons, with a metallic film visible through the cylinder wall.

The piston 6 can be made of transparent materials such that the color of the lipstick 10 contained in the capsule 1 can also be visible through the piston 6.

The material constituting the piston is inert with respect to the lipstick composition that the cylinder contains.

Additionally, in the context of the embodiment of the capsule shown, the piston 6 can be covered with a cover 7 made of rigid material, which assures a better application of a rod on the piston in order to allow movement thereof in the cylinder 2. In order to also center the rod for movement of the piston, the cover 7 can also include an imprint 8 corresponding to the end of the rod so as to center the rod on the axis of the cylinder 2.

The cover 7 can also be made of transparent material.

The second end 4 of the cylinder 2 of the capsule 1 forms an outlet nozzle 9 of the capsule that is initially closed by a separable head 11.

The separable head 11 has a peripheral groove 12 which serves to guide the means performing the separation of the head in the filling device that will be described later, and in that way make the separation of the separable head 11 easier.

It should be noted that the second end could be coated with a metallic layer for aesthetic purposes.

In FIG. 1, the capsule 1 is filled with a lipstick composition 10 in solid form.

The capsule 1 includes a quantity of the lipstick composition with which to prepare a single stick of lipstick.

The quantity could possibly be slightly more than that needed, so as to account for a dead volume in the capsule at the time of the preparation of the stick of lipstick.

As for FIG. 2, it shows a unit container constituted by a lipstick applicator tube mechanism 13 suited to be filled via the filling device which will be described later.

The mechanism 13 comprises a protective tube 14 which extends between a first 15 and a second 16 end, where the protective tube has a general cylindrical shape of revolution with central axis X.

The second end 16 is closed by a heat sealed, for example, seal 17. The seal 17 can also be nested in the second end 16. The second end 16 also has a clipped-off shape 18.

The protective tube 14 can, for example, be made of plastic and could optionally be covered on the outside on the visible parts thereof (meaning on the parts thereof near the second end 16) by a decorative metal sleeve 19.

The protective tube 14 comprises a cup 20 made for example of plastic.

The cup 20 has a bottom 21 and a lateral wall 22 with a general cylindrical shape of revolution centered on the axis X. This lateral wall 22 extends from the bottom 21 up to a free end 23 in the direction of the second end 16 of the protective tube 14.

The bottom 21 of the cup 20 is provided with a central opening 24 and also a central tip 25 formed from a single part under the bottom 21 of the cup 20.

The mechanism 13 additionally comprises a maneuvering device 26 which includes a base 27 which forms the lower part of the mechanism 13.

The base 27 comprises a bottom 28 having a cylindrical through opening 29 with axis X, aligned with a central opening 24 of the cup 20.

The base 27 may comprise a thinner portion 30 on which a lipstick tube protective cover can come to nest.

The base 27 can be assembled rotatable relative to the protective tube 14. To do that, the mechanism 13 comprises a screw 31 rigidly connected with the slider 32, which slides along the X axis inside the protective tube 14, and a nut 33 which is screwed on the screw 31 and rotationally rigidly connected with the base 27.

Since the core of the invention is neither in the implementation of the mechanism 13 nor in operation thereof, it will not be described. However, the operation the mechanism 13 is the same as that described in the earlier patent application FR 2,952,911, whose content is incorporated here by reference.

The device for filling a lipstick applicator tube is now going to be described with reference to FIGS. 3 to 10.

Figure 2:
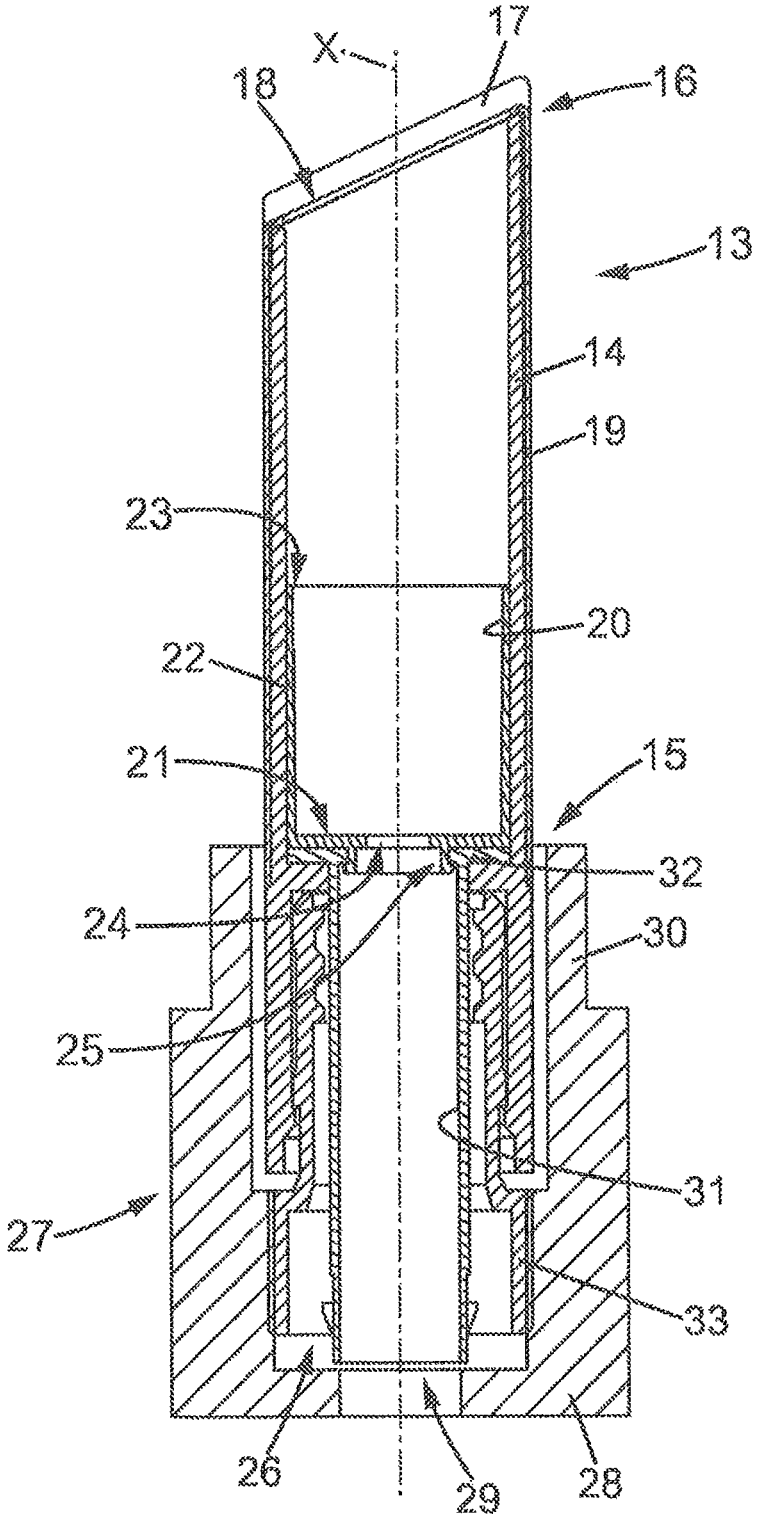
FIG. 2 shows an empty applicator tube mechanism in section, side view.
Figure 3:
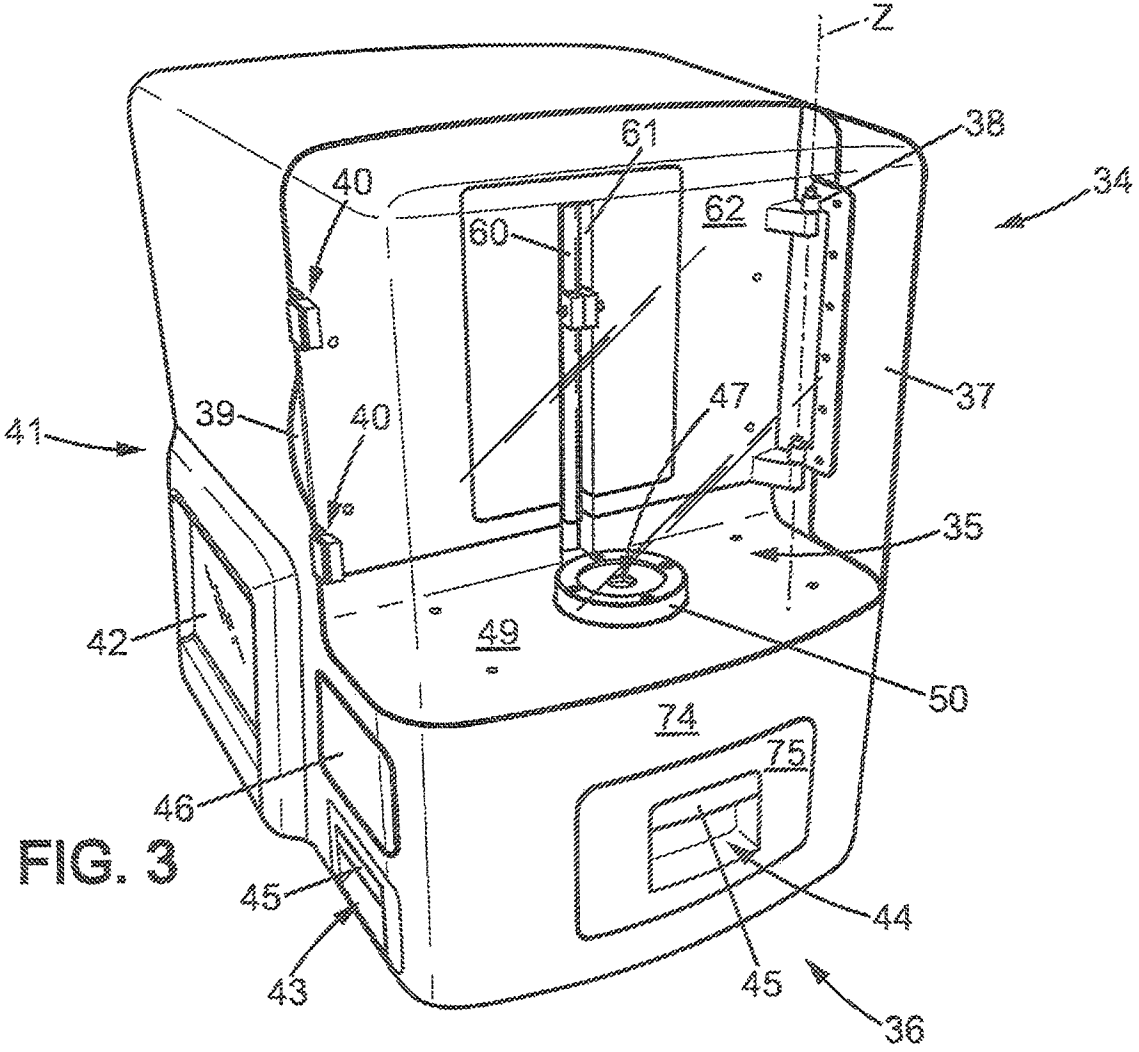
FIG. 3 shows a device for filling an applicator tube according to the invention, seen in perspective and profile.
Figure 4:
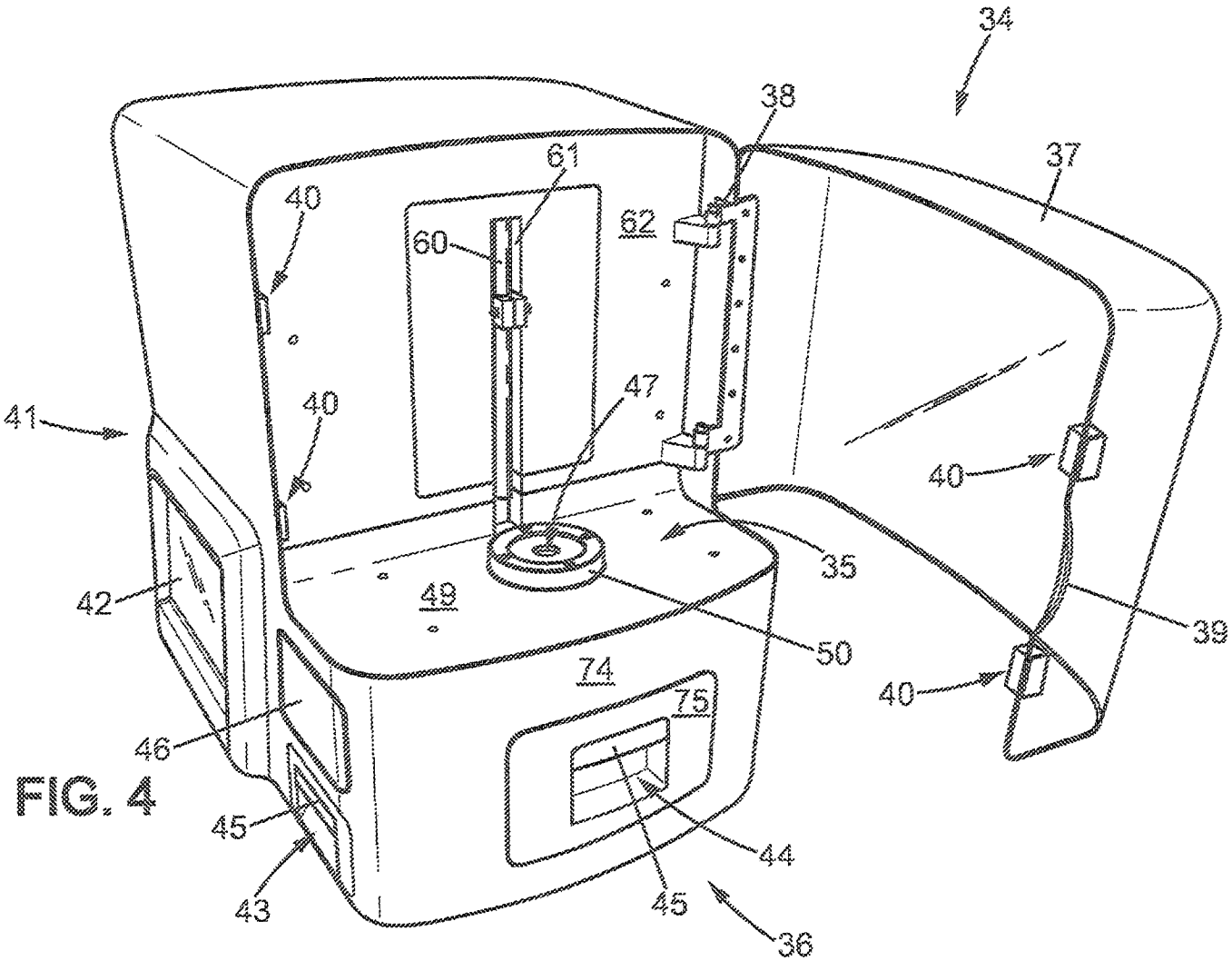
FIG. 4 shows the device from FIG. 3, seen in perspective and profile, when the cover is open.

FIG. 3 shows a filling device 34 which is designed to receive both a capsule 1 such as shown in FIG. 1 and also a mechanism 13 such as shown in FIG. 2.

The filling device 34 includes a compartment 35 which is implemented on a front surface 36 of the device 34 and which is designed for receiving a capsule 1.

The compartment 35 is closed by a protective cover 37 which is movably mounted between a closed position (shown in FIG. 3) and an open position (shown in FIG. 4) by pivoting around a hinge 38 with axis Z substantially vertical.

A handle 39, made as a single part with the cover 37, is provided opposite the hinge 38, so as to make it easier for an operator 100 to grip the housing for opening thereof.

A system of magnets 40 placed between the housing and the device 34, on either side of the handle 39, serves to hold the cover 37 in closed position.

The device 34 also comprises on a lateral surface 41 a display screen 42. The function of this display screen is to give an operator 100 information on the operational status of the filling device 34, or else instructions for operating the device 34, or even for indicating to the operator the progress status of the filling process implemented by the filling device 34. In other words, the screen 42 provides information to an operator making use of the device.

The screen 42 could also serve to control the operation of the device 34 by being tactile and equipped with suitable means for controlling the implementation of certain steps by touching certain preset areas on said screen 42.

The lateral surface 41 of the device 34 also comprises a retrieval drawer 43 were separable heads 11 from capsules 1 are retrieved after having been cut off during the process of filling a lipstick applicator tube mechanism 13.

The retrieval drawer 43 opens laterally and is preferably removable so as it can be emptied without having to touch the separable heads with lipstick residues.

Finally, the lateral surface 41 includes a hatch 46 with which to access internal elements of the filling device 34 in order to allow their maintenance.

On the front surface 36 of the device 34, under the capsule compartment 35, a second drawer 44 is also located with which to insert a mechanism 13 into the filling device 34.

The drawers 43 and 44 are both equipped with a handle 45 to make it easier for an operator 100 to grasp them.

The compartment 35, designed to receive capsule 1, is equipped with a reception housing 47 with a shape substantially complementarity to that of the capsule 1. In other words the inner shape of the housing 47 is substantially cylindrical.

Figure 5:
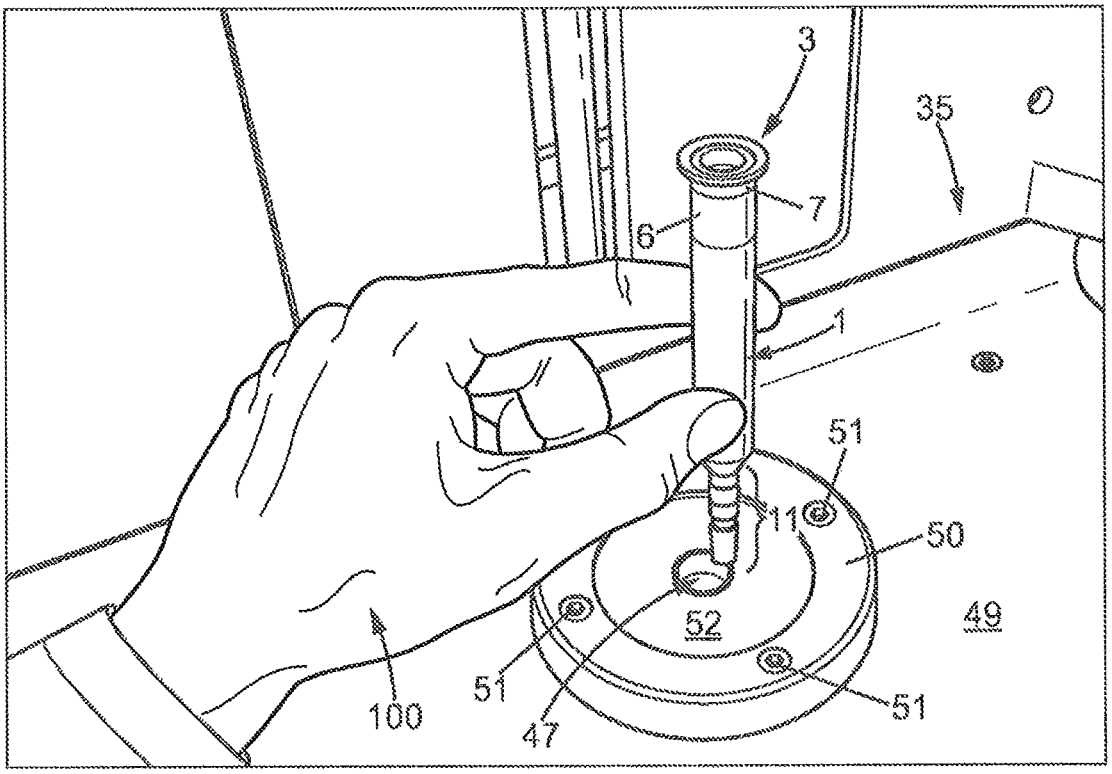
FIG. 5 shows a capsule being placed in a housing of the device, with the capsule and device shown in perspective.

The housing 47 has an end open towards the inside of the compartment 35 in order for an operator 100 to insert a capsule 1 into it (see FIG. 5).

The housing 47 is arranged at least partially inside a box 48 which is attached under a bottom 49 of the compartment, where the bottom 49 is substantially horizontal when the device 34 rests on a horizontal surface.

The box 48 is held onto the bottom 49 of the compartment 35 by a cylindrical head 50 to which it is attached (for example by means of screws 51), where the cylindrical head 50 is attached to the bottom of the compartment 35. In other words, the cylindrical head 50 and the box 48 are located on either side of a wall forming the bottom 49 of the compartment 35.

In that way, only the head 50 of the box 48 is visible in the compartment 35 and the housing 47 also passes through the head 50 of the box.

Figure 6:
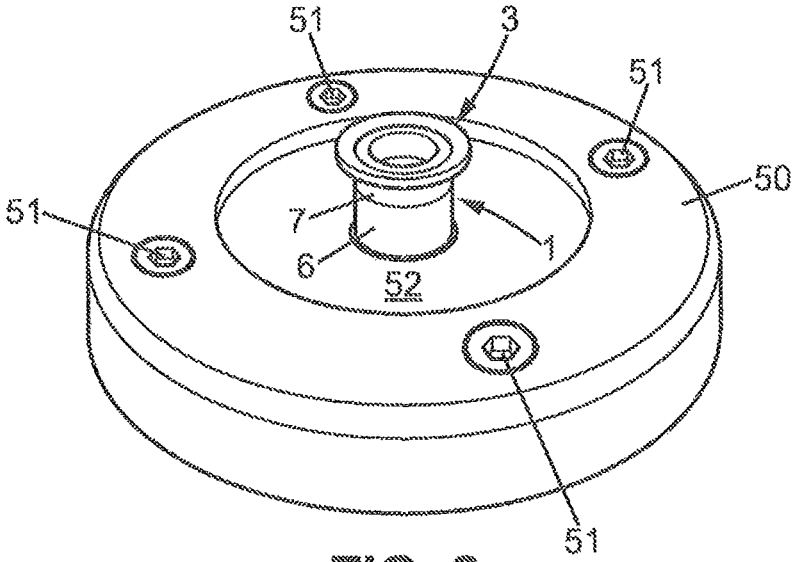
FIG. 6 shows the capsule placed in the housing for the device, seen in perspective.

As can be seen in FIG. 6, when the capsule 1 is inserted into the housing 47, the first end 3 of the cylinder 2 projects above the upper surface 52 of the head 50 of the box. In this way, grasping the capsule in order to remove it from the housing 47 is in particular made easier.

In order to allow this projecting position of the first end 3, the housing 47 has a depth p which is less than the height h of the cylinder 2 of the capsule 1.

Additionally, the housing 47 has a conic frustum shaped bottom 53, opened with a through opening 54. The through opening 54 has a section with a larger diameter than the diameter of the separable head 11 so said separable head can pass through. As for the bottom 53, it has a substantially conic frustum shape in which the second end 3 of the cylinder 2 of the capsule 1 can rest.

Figure 7:
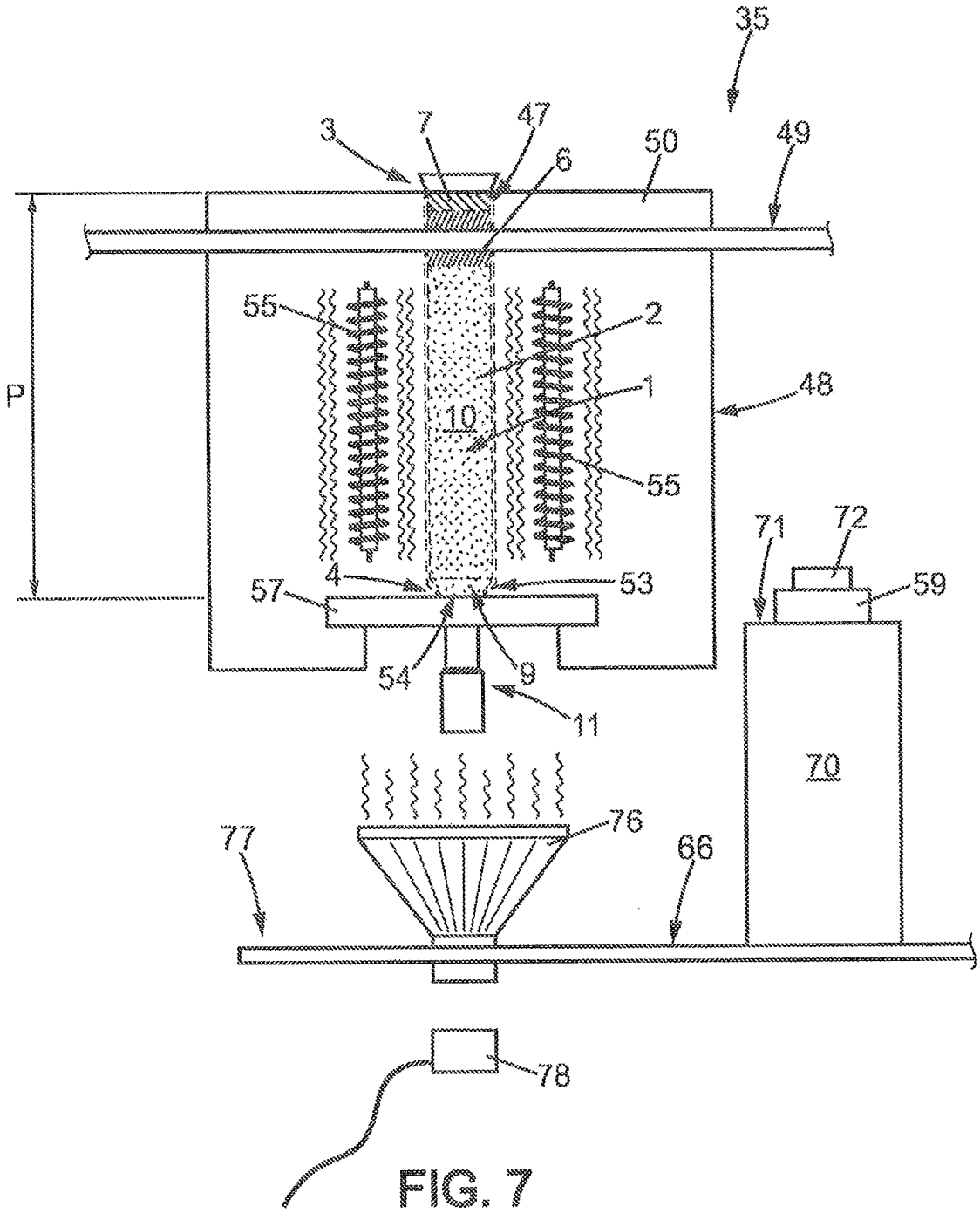
FIG. 7 is a side view of the device whose walls have been cut or withdrawn in order to show the position of the drawer for the device, relative to the housing containing the capsule, when means of heating are active.

The box 48, shown in more detail in FIG. 7, comprises at least one heating electric resistance 55 distributed uniformly around the housing 47 and over at least one large portion of the depth thereof p (at least half of the depth p of the housing 47).

The box 48 is also equipped with two cutting blades 56 (visible in FIG. 9*c*), where each of the blades 56 is attached on a pusher 57 mounted mobile in displacement between a cutting position and a resting position.

The pushers 57 are held in resting position by each being constrained by a spring 58. The two pushers 57 are brought into cutting position when they are pushed by two cylindrical rollers 59 which are moved.

The movement of the cylindrical rollers 59 will be described later. The rollers 59 are attached to an element of the drawer 44 of the filling device 34 which will be described later.

The two blades 56 are in that way mounted mobile between an inactive position (corresponding to the resting position of the pushers 57) and an active position (corresponding to the cutting position of the pushers 57) along which the blades 56 open the outlet nozzle 9.

Additionally, the assembly constituted by the pushers 57, the springs 58 and the cylindrical rollers 59 constitute an actuator suited for moving the blades between said active position and said inactive position, and vice versa.

The box 48, comprising the housing 47, and equipped with means of heating 55 and means 56 and 57 of assuring the opening of the output nozzle 9 of the capsule 1, constitutes a means for preparation of the capsule, with which both to fluidity the content thereof (meeting the stick of lipstick 10) by heating and to open the capsule in order to extract therefrom the fluidified content.

The filling device 34 additionally comprises, conforming to the invention, means for casting the lipstick 10 which are now going to be described by referring to FIGS. 3, 4, 9*a* and 9*b*.

The means for casting, with which in particular to expel the lipstick 10 from the capsule 1, comprise a rod 60 which is vertically oriented in the compartment 35.

Figure 9A:
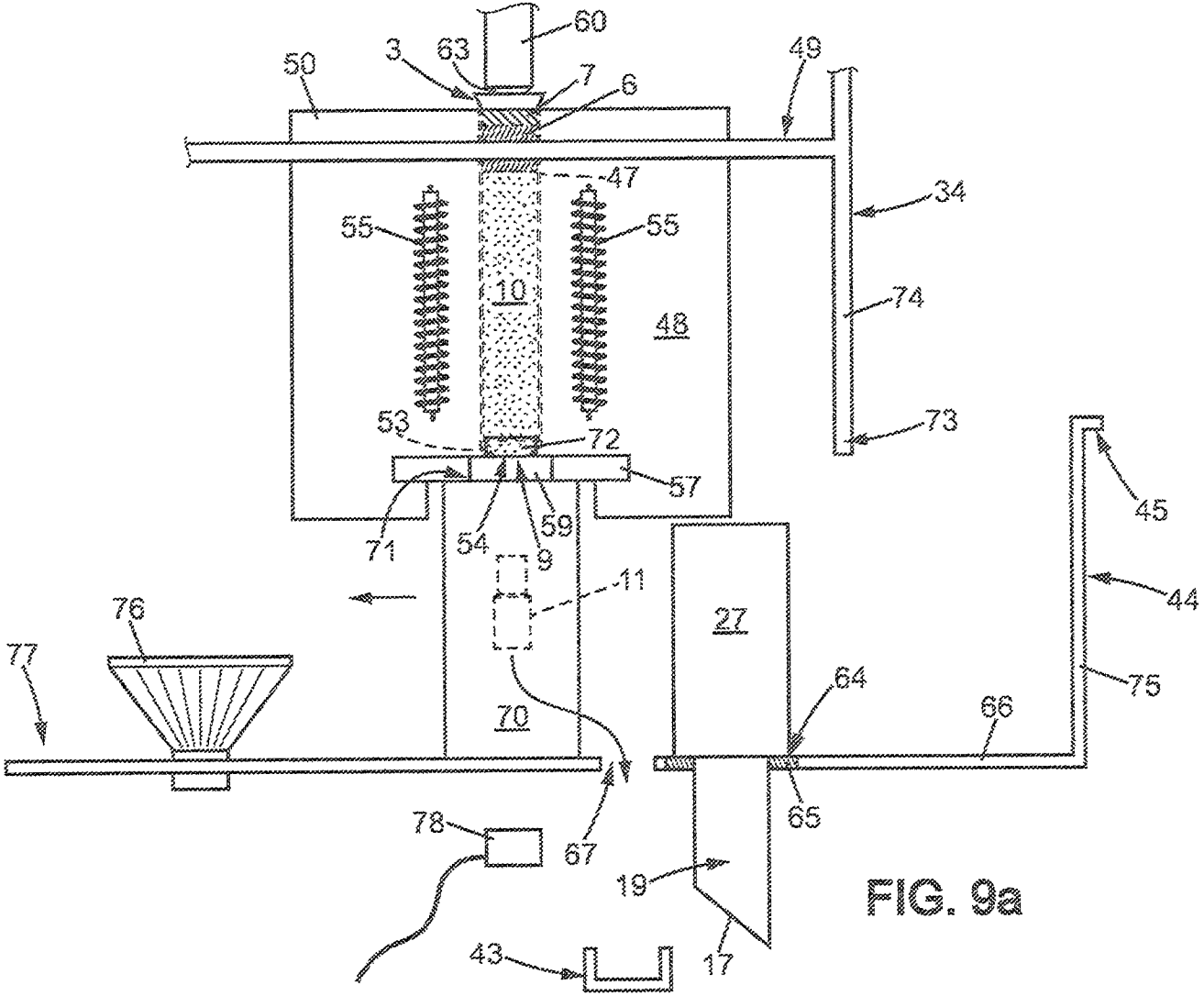
FIGS. 9*a* and 9*b* schematically show, in side view, the positioning of the drawer in the device, respectively at the moment when the end of the capsule is cut and at the moment when the mechanism is positioned on the open capsule.
Figure 9B:
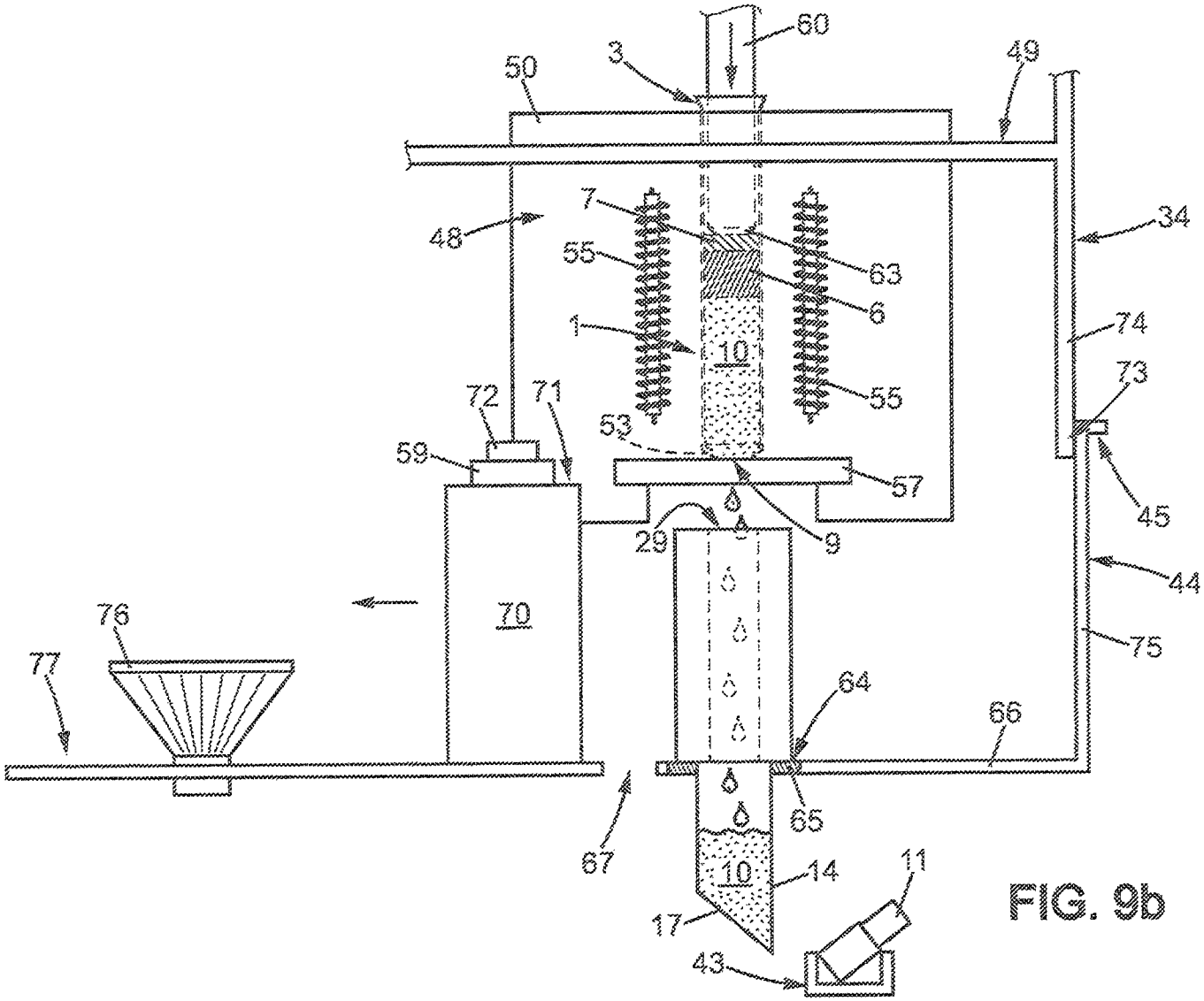
Figure 9C:
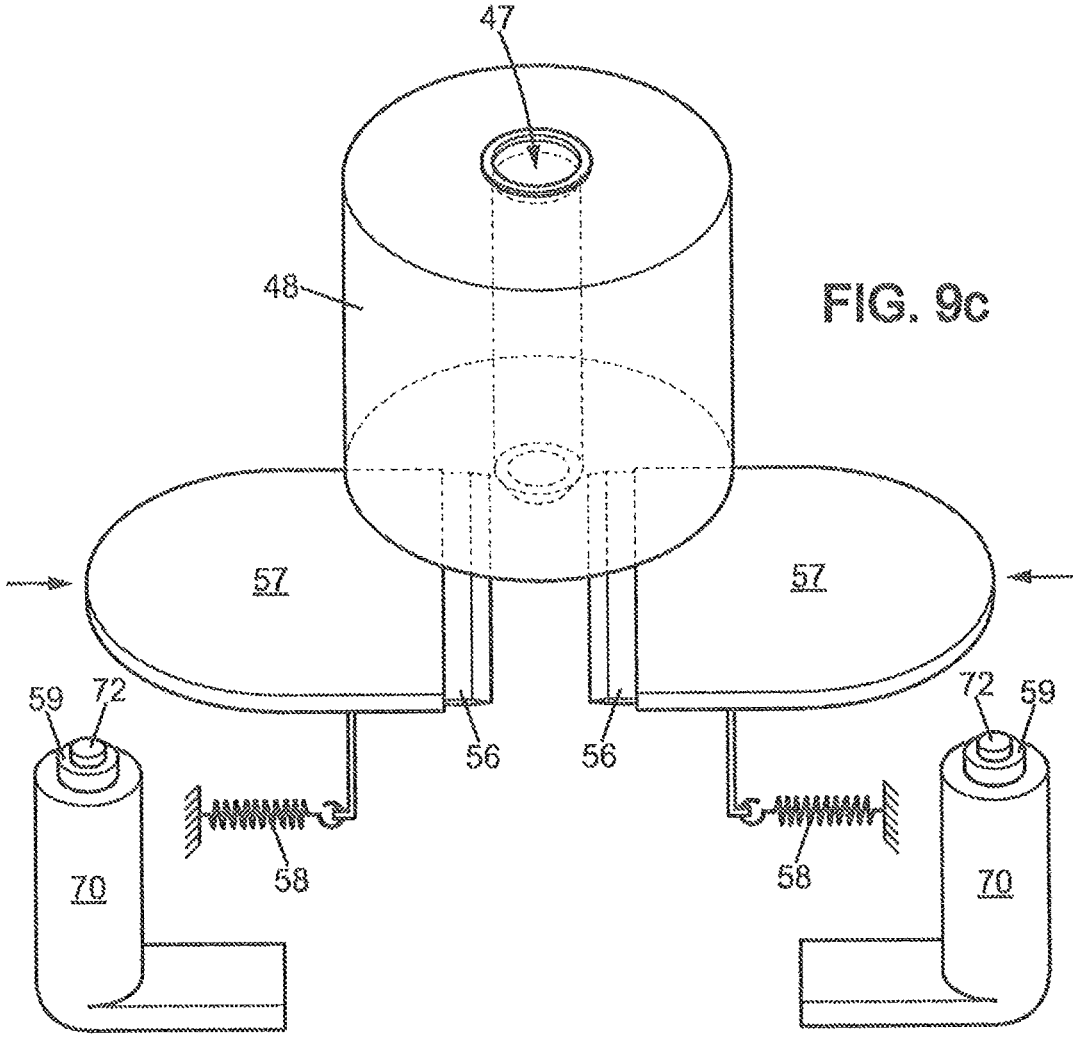
FIG. 9*c* shows another schematic view of the drawer in front view, partial view and in perspective, showing the two blades actuated by two rollers bearing onto pushers, with each pusher carrying the blade

The rod is mounted mobile between an inactive position (shown in FIGS. 3 and 4) according to which it is separated from the box 48, stored (or retracted) into a groove 61 arranged in a lateral surface 62 with the compartment 35 and an active position according to which one end 63 of the rod 60 is suited for exerting pressure on the piston 6 of the capsule 1 (see FIGS. 9*a* and 9*b*).

To switch from the active position to the inactive position of the rod, the rod is connected to a jack (not shown) with which to move the rod vertically. The jack is placed in the body of the filling device 34. Additionally, the assembly constituted by the rod 60 combined with the jack is also mounted mobile in horizontal movement to bring the axis of the rod 60 into the axis of the housing 47 of the box 48.

The means providing the horizontal movement of the rod and the jack are not visible in the figures because they are also enclosed in the body of the device 34. They can be implemented a jack system, or any other means well known to the person skilled in the art.

In order to allow the lipstick 10 to flow into a lipstick applicator tube mechanism 13, the filling device 34 comprises a second housing 64, suited to receive a mechanism 13 placed top-down (meaning upside down with the bottom 28 of the base 27 oriented upward) and to arrange it in the axis of the housing 47 (meaning in the axis of the capsule 1 when it is placed in the housing 47) in order to allow the filling thereof by the through opening 29 of the mechanism located in the bottom 28 of the base 27 thereof.

Figure 8A:
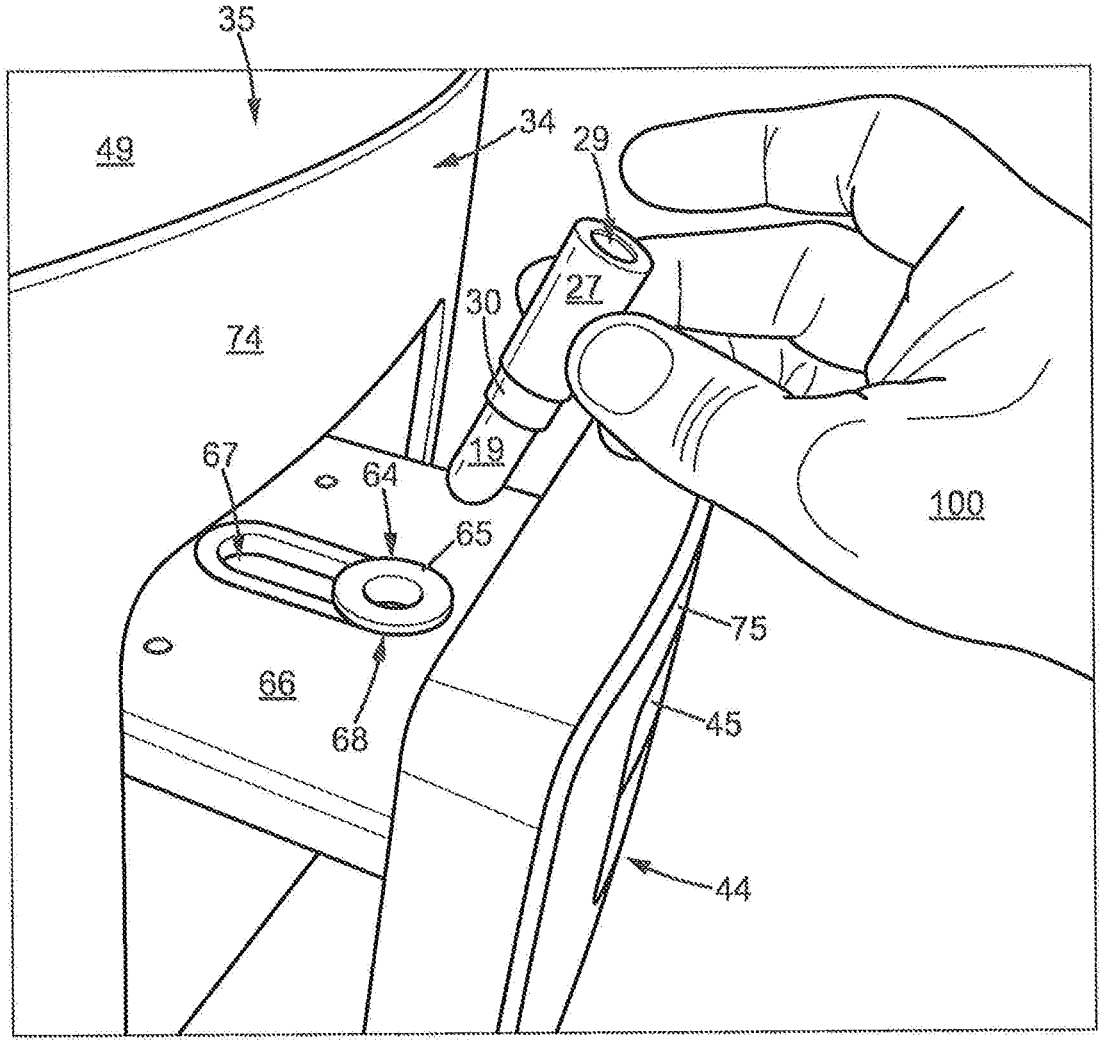
FIGS. 8*a* and 8*b* show the device from FIGS. 3 to 7, seen in perspective, with the drawer in an open position in order to allow the positioning of an applicator tube as shown in FIG. 2.
Figure 8B:
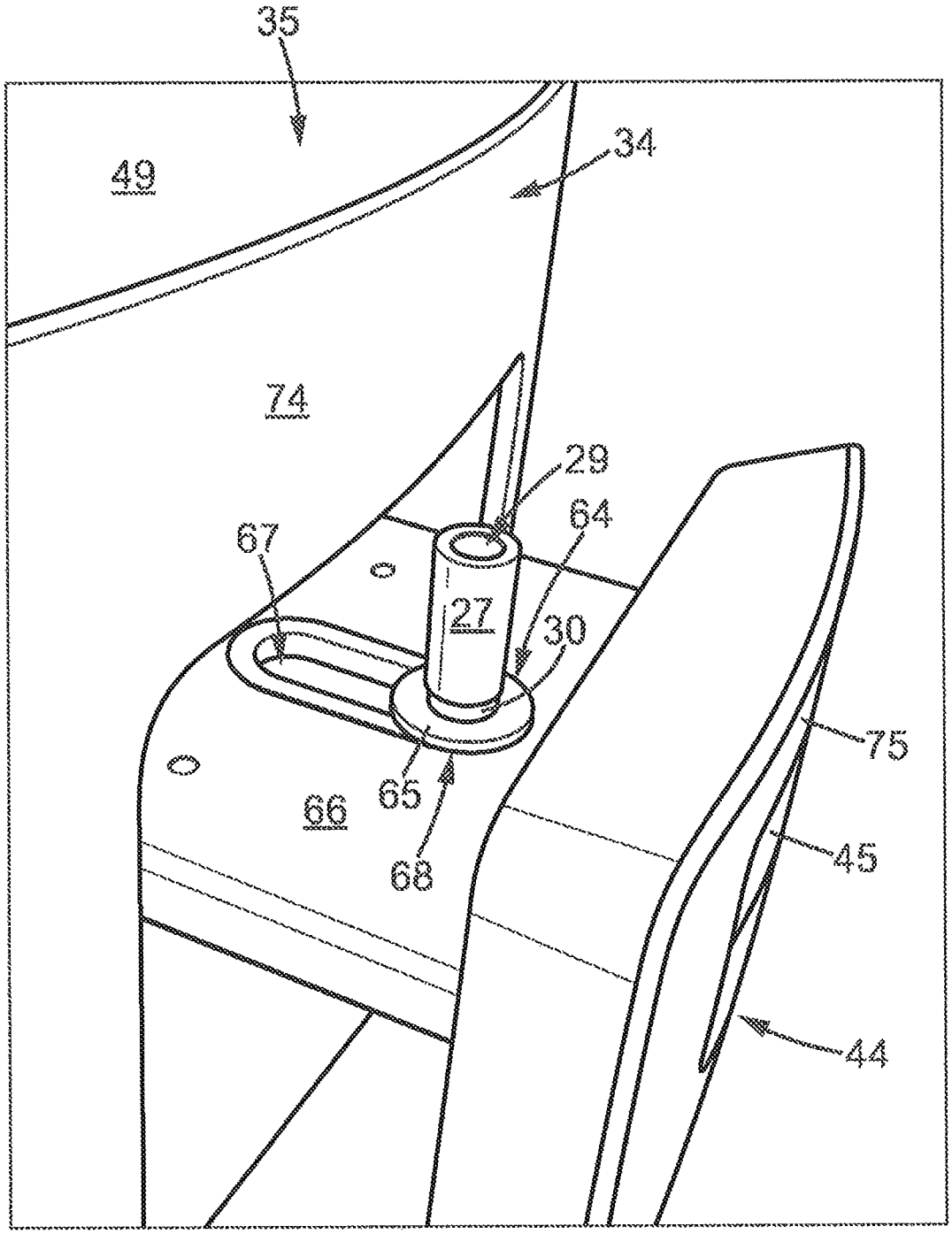

The second housing 64 is arranged in the second drawer 44 of the filling device, as shown in particular in FIGS. 8*a* and 8*b*.

The drawer 44 comprises a substantially horizontal tray 66 in which is arranged a through opening 67 with a shape elongated in the direction of opening of the drawer 44.

The housing 64 is made of a ring 65 which is attached in the through opening 67, at the end 68 thereof oriented towards the handle 45 of the drawer 44.

The orientation of the elongated-shape through-opening 67 and the position of the ring 65 in said opening 67 allows the evacuation of the removable head 11 through the opening 67 (when it is cut, during closure of the drawer 44) just before the positioning of the mechanism 13 in the axis of the housing 47 of the box 48 (in other words next to the outlet nozzle of the capsule—see FIG. 9*a*).

In the area of one end 69 of the through opening 67, where end 69 is opposite the end 68, and on either side of an axis of symmetry of the through opening 67, the tray 66 comprises two columns 70. A single column is visible in FIGS. 7, 9*a* and 9*b* which show the drawer schematically in side view.

Each of the columns 70 bears, at the free end 71 thereof, one of two cylindrical rollers 59 with which to move the pushers 57, which perform the opening of the nozzle 9 of the capsule 1 by cutting the separable head 11.

The cylindrical rollers 59 and the columns are coaxial.

Above each of the cylindrical rollers 59, a stop element 72 is also set coaxially. The stop element 72 blocks the drawer 44 from fully opening by coming to a stop against one end 73 of a wall 74 of the filling device 34.

The wall 74 comes substantially up to the wall 75 of the drawer 44 when the drawer 44 is closed.

Finally, the tray 66 of the drawer 44 is equipped with a halogen device 76 directed upward.

The halogen device 76 is provided at one end 77 of the tray 66, where the end 77 is located substantially in the back of the drawer 44.

The halogen device 76 serves to fluidify the lipstick 10 located in the end 4 of the capsule 1, meaning the lipstick 10 which is located in the area of the separable head 11. In fact, it was observed that the heating resistance 55 which is located in the box 48 was not sufficient to homogeneously fluidify the lipstick 10 in the capsule 1. If the lipstick 10 is poorly fluidified in the area of the outlet nozzle 9 of the capsule 1, then:

- either the lipstick flows poorly;
- or else it forms an unaesthetic accumulation of material on the cover 77 located in the bottom of the mechanism and therefore on the end of the stick of lipstick which will be formed, which is unacceptable.

In order to assure a proper positioning of halogen device 76 near the housing 47, and therefore near the separable head 11 when the capsule 1 is located in the housing 47, the filling device 34 conforming to the invention may comprise a position sensor 78 for the halogen device.

When the sensor 78 detects the presence of the halogen device across from it, it orders the lighting thereof (see FIG. 7).

Finally, the filling device 34 comprises means for cooling 79 of the lipstick 10 filling mechanism.

The means of cooling 79 are provided in the area of the housing 64 when the drawer 44 is in closed position. In this way, the means of cooling 79 are relatively close to the mechanism 13 in order to cool and solidify the fluidified lipstick 10 which is located in the mechanism 13 while making a tube of lipstick.

Figure 10:
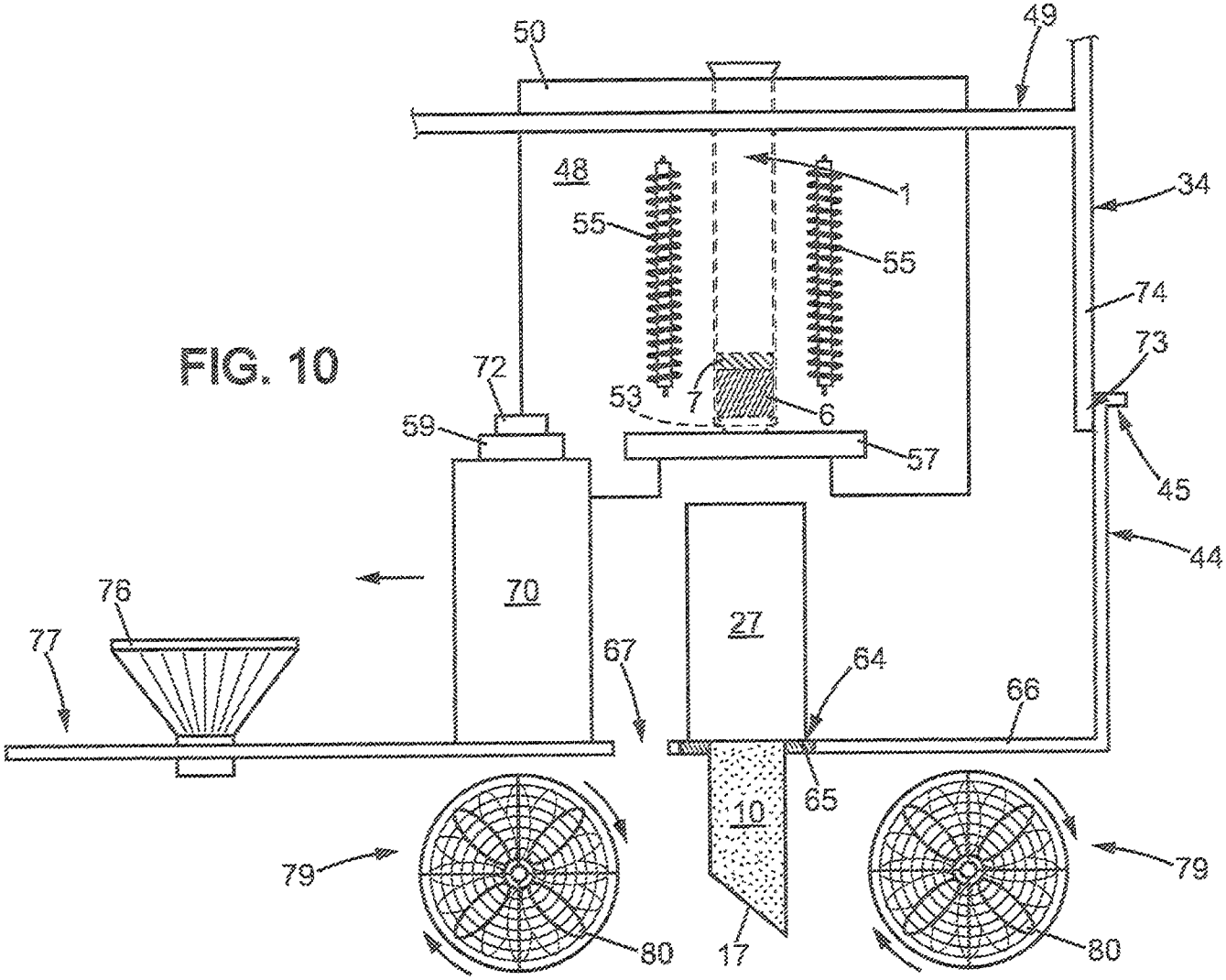
FIG. 10 shows the cosmetic product filling mechanism during the drying step, in the drawer showed schematically in side view, where the mechanism is shown in section view in order to show the contents thereof.

The means for cooling 79 can include a ventilation or blower system 80, symbolized schematically by fans on FIG. 10.

Now the process according to the invention is going to be described with reference to FIGS. 3 to 12; this process uses the filling device 34 which was just described in order to make a tube of lipstick on demand.

Initially, the filling device 34 conforming to the invention appears as shown in FIG. 3, meaning with the protective cover 37 thereof in closed position.

Such a device can be made available to clients in a boutique or be used by operators in a boutique, where the operators fill the lipstick tube mechanisms at the request of the clients.

Initially the display screen 42 of the filling device 34 indicates to an operator 100 whether the device 34 is ready to perform a filling or whether maintenance might be required.

When the client wants a personalized lipstick tube, the client first chooses from a display case, comprising a series of capsules 1 of various colors, the lipstick 10 color that she wants.

The operator 100 then takes a capsule 1 of the desired color.

The operator 100 then opens the protective cover 37 of the filling device 34 (FIG. 4) and she places a capsule 1, upside down (see FIG. 5), in the housing 47.

The end 3 of the capsule 1 is then positioned projecting above the upper surface 52 of the head 50 of the box 48.

The operator 100 then closes the protective cover 37.

Conforming to the invention, the lipstick 10 contained in the capsule is then fluidified according to a preparatory step by heating of the capsule (FIG. 7). This heating can be controlled by the operator 100 through the screen 42 which can be tactile.

The heating can also be automatic when the presence of a capsule 1 is detected in the housing 47 and when the halogen device 76 is correctly placed opposite the sensor 78.

In order to initiate the heating, it can be indicated to the operator 100 via the screen 42 to slightly pull the drawer 44 in order to arrange it according to a first heating position, where in this position the halogen device 76 is located opposite the separable head 11 of the capsule 1 that extends past the housing 47.

The screen can then show the operator 100 a wait time and show when the heating step is finished.

Conforming to the invention, the heating step lasts between one and five minutes. Preferably, the heating step lasts four minutes.

The temperature to which the capsule is heated is included substantially between 80 and 100° C., such that the product reaches a temperature assuring fluidification thereof (about 75° C.). Ideally the heating temperature is substantially 90° C.

When the heating is over, the screen 42 shows the operator 100 that a lipstick mechanism 13 can be inserted into the filling device 34.

The operator 100 then opens the drawer 44 and inserts a mechanism 13 in the housing 64 of the drawer, where the mechanism 13 is also placed upside down, meaning with the base 27 of the maneuvering device oriented upward (see FIGS. 8*a* and 8*b*).

The operator 100 then closes the drawer 44. By this closing action, several operations are actuated simultaneously:

First, the closure of the drawer 44 leads to a movement of the two columns 70 bearing the cylindrical rollers 59 (FIG. 9*c*), which moves both pushers 57 and cuts the end of the separable head 11 from the capsule 1. The separable head 11 falls through the opening 67 into the retrieval drawer 43 (the drawer 43 is shown very symbolically by a cup in FIGS. 9*a* and 9*b* in order to simplify reading thereof).

And also, when the drawer 44 is correctly closed, this closure is detected and the rod 60 is moved via the horizontal displacement device and the jack providing the vertical movement thereof and the rod 60 goes into the capsule 1 by bearing on the piston 6.

The fluidified lipstick 10 is then expelled from the capsule 1 through the outlet nozzle 9 and pours into the through opening 29 of the bottom of the mechanism 13 (see FIG. 9*b*).

When the piston 6 reaches the bottom of the capsule 1, the lowering of the rod 60 is stopped.

The rod 60 then rises and returns to initial retracted position in the storage groove 61 thereof.

A cooling step is then automatically launched by the filling device 34.

The screen 42 then indicates to the operator 100 that the cooling step is in progress. It can also indicate a countdown for the cooling time of the lipstick 10 filling mechanism 13.

In the context of the process according to the invention, the cooling step, shown schematically in FIG. 10, is done over a time included substantially between one and five minutes. Preferably, the cooling step lasts substantially four minutes.

Concretely, the cooling step is done by blowing cold air on the sleeve 19 of the mechanism 13 which serves to solidify the lipstick 10 in the protective tube 14 of the mechanism 13.

Figure 11:
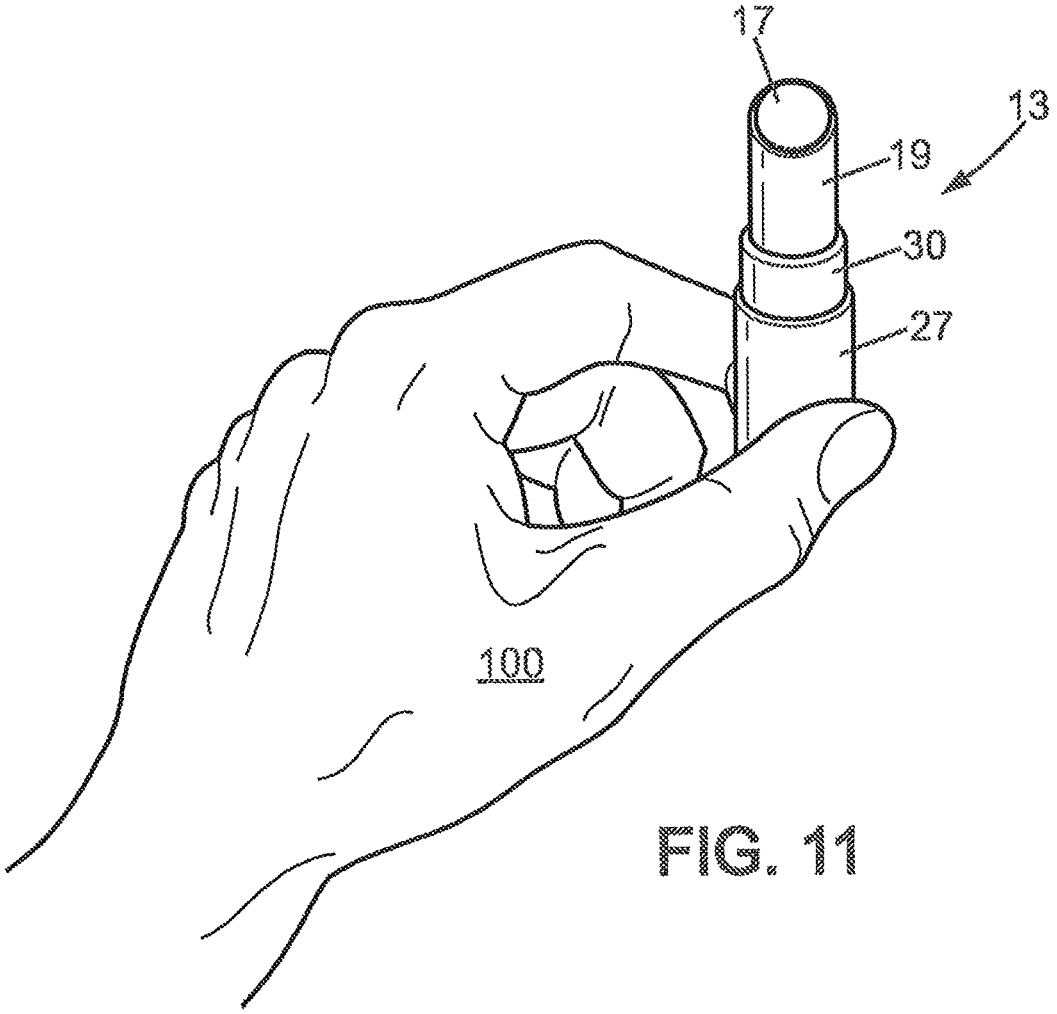
FIG. 11 shows schematically, in perspective view, the withdrawal of the applicator tube after cooling and opening of the drawer.
Figure 12:
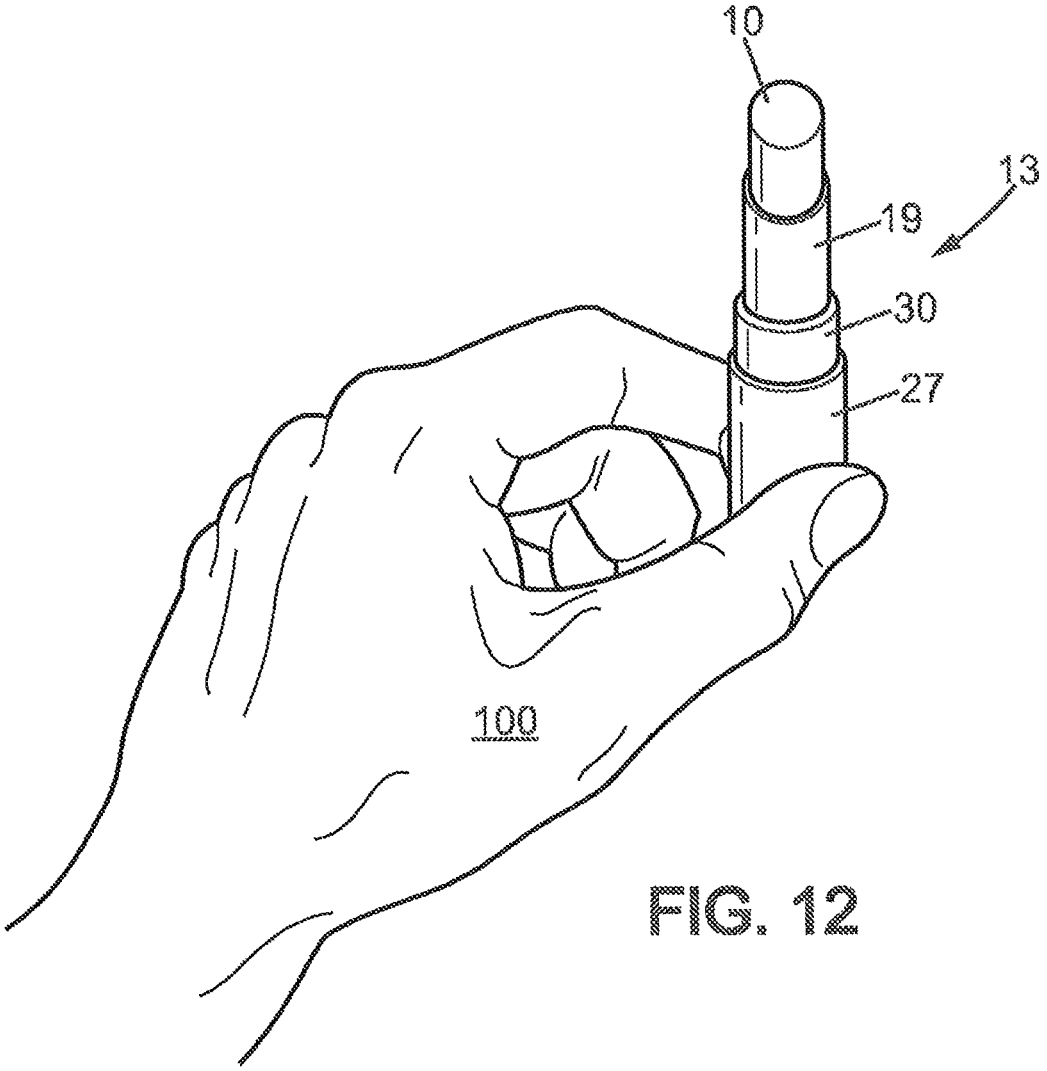
FIG. 12 shows schematically a step of verification of the condition of the applicator tube and operation of the mechanism after withdrawal of an end seal which initially closes the mechanism.

When the cooling is done, the screen 42 indicates it to the operator and invites the operator to retrieve the mechanism 13 filled with solidified lipstick 10 (see FIG. 11)

The operator 100 then manually removes the seal 17 which closes the end of the protective tube 14 and actuates the mechanism 13 in order to verify the operation thereof and in order to visually heck the solidified stick of lipstick 10.

The operator 100 then inserts the mechanism 13 into a lipstick tube of the client's choice.

From the preceding description it is understood how the invention enables making personalized lipstick tubes of a client's choice.

Additionally, the filling device from the invention is distinguished in that it includes a removable capsule in which a closing piston is inserted whose function is to expel the lipstick composition out of the capsule after the heating step.

The insertion of the piston inside the capsule has the advantage of avoiding any contact between the nonremovable parts of the filling device and the lipstick composition. In that way, once the casting operation finishes, the empty capsule is removed from the device without the composition having contaminated a part of the device, such that it is possible for the operator to repeat a new lipstick stick production operation by inserting a new capsule 1, advantageously of a different color and/or texture and a new mechanism 13, without there being a need for prior cleaning of the parts of the device which would've previously been contaminated by the composition.

In that way, the device is distinguished from machines including reservoirs or devices in which the piston 6 would be attached to the rod 60.

It should be understood that the invention is not specifically limited to the embodiment shown and described above, and that it extends the implementation of any equivalence means.

The invention claimed is:

1. A process for filling a unit container with a cosmetic product from a capsule, said process comprising at least the following steps:

a step of providing a capsule comprising a dose of said cosmetic product, said cosmetic product being in a solid form in the capsule, wherein said dose of said cosmetic product is enough to fill only one unit container and wherein said capsule comprises a tube filled with said dose of cosmetic product, wherein said tube extends between a first end closed by a piston slidably mounted in the tube and a second end forming an initially closed outlet nozzle;

a step of opening the outlet nozzle of the capsule;

a step of casting in which said cosmetic product is cast into a unit container by actuating the piston of the capsule in order to expel said cosmetic product by the outlet nozzle;

and, a step according to which said cosmetic product is fluidified in the capsule by heating.

2. The process according to claim 1, wherein the heating of the cosmetic product in the capsule is done at a temperature included between 80 and 100° C.

3. The process according to claim 1, wherein the heating is done for a time included between one and five minutes.

4. The process according to claim 1, wherein the step of opening said outlet nozzle of said capsule can be done by cutting off a separable head that said capsule comprises.

5. The process according to claim 1, additionally comprising, after said casting step:

a cooling step in which the cosmetic product is solidified in said unit container.

6. The process according to claim 1, wherein said cooling step is done by blowing air.

7. The process according to claim 1, wherein said cooling step is done for a time included between one minute and five minutes.

8. A device for filling a unit container with cosmetic product from a capsule, said capsule comprising a tube extending between a first end closed by a piston slidably mounted within the tube and a second end forming an outlet nozzle which is closed, wherein said tube is filled with a cosmetic product and wherein the product is in solid form, wherein said outlet nozzle of the capsule is hermetically closed by a separable head, where said capsule is removable from said device, said device comprising:

means for opening, suited for opening the outlet nozzle of said capsule;

and means for casting said cosmetic product, suited for casting said cosmetic product in the unit container by actuating the piston of the capsule in order to expel said cosmetic product by said outlet nozzle.

9. The device according to claim 8, comprising:

means for preparation of the capsule, suited for fluidifying said solid cosmetic product contained in the capsule by heating and for opening the outlet nozzle of said capsule;

and means for casting said cosmetic product, suited for casting said fluidified cosmetic product in the unit container by actuating the piston of the capsule in order to expel said cosmetic product by said outlet nozzle.

10. The device according to claim 8, wherein said means of preparation of the capsule comprise:

a first reception housing suited for receiving said capsule;

a heating element suited for heating said capsule through said first housing;

and an opening element suited for opening said outlet nozzle of said capsule.

11. The device according to claim 8, wherein said heating element can comprise a heating resistance distributed around said first reception housing and also a halogen device.

12. The device according to claim 8, wherein the means for opening the outlet nozzle of the capsule comprise at least one cutting blade which is mounted mobile between an inactive position and an active position according to which said at least one blade opens the outlet nozzle, and also an actuator suited to move said blade between said active position and said inactive position and vice versa.

13. The device according to claim 8, wherein said means for casting comprises a rod associated with a jack, where said rod is mounted mobile in movement between a retracted inactive position and an active position according to which one end of the rod is suited to exert pressure on said piston of the capsule slidably mounted in said tube of said capsule.

14. The device according to claim 8, said device comprising a second reception housing suited to receive said unit container for cosmetic product.

15. The device according to claim 8, wherein said second reception housing for said unit container for cosmetic product is laid out in a drawer mounted mobile in movement between a retracted position serving to insert said unit container for cosmetic product into said second reception housing and a filling position according to which said unit container for cosmetic product is suited to be found next to the outlet nozzle of said capsule.

16. The device according to claim 14, comprising means for cooling said unit container for cosmetic product through said second reception housing.

17. The device according to claim 8, said device comprising means for recovering a separable head, where said head is suited to close the outlet nozzle of the capsule before opening of the outlet nozzle.

18. The device according to claim 8, comprising a display screen suited for delivering messages to an operator to inform said operator of a progression of the steps of a process for filling a unit container with a cosmetic product from a capsule comprising a dose of said cosmetic product using said device, and/or for giving the operator instructions for use of said device.

* * * * *